US009181763B2

(12) United States Patent
McIntosh et al.

(10) Patent No.: US 9,181,763 B2
(45) Date of Patent: Nov. 10, 2015

(54) APPARATUS FOR SUPPORTING OR HANDLING TUBULARS

(75) Inventors: Richard McIntosh, Lafayette, LA (US); Toby Scott Baudoin, Rayne, LA (US)

(73) Assignee: 2M TEK, Inc., Scott, LA (US)

( * ) Notice: Subject to any disclaimer, the term of this patent is extended or adjusted under 35 U.S.C. 154(b) by 237 days.

(21) Appl. No.: 13/636,541

(22) PCT Filed: Mar. 22, 2011

(86) PCT No.: PCT/US2011/000520

§ 371 (c)(1),
(2), (4) Date: Sep. 21, 2012

(87) PCT Pub. No.: WO2011/119214

PCT Pub. Date: Sep. 29, 2011

(65) Prior Publication Data

US 2013/0008641 A1 Jan. 10, 2013

Related U.S. Application Data

(60) Provisional application No. 61/340,893, filed on Mar. 24, 2010.

(51) Int. Cl.
*E21B 19/10* (2006.01)

(52) U.S. Cl.
CPC ..... *E21B 19/10* (2013.01)

(58) Field of Classification Search
USPC ..... 166/77.51, 77.52, 77.53, 85.1
See application file for complete search history.

(56) References Cited

U.S. PATENT DOCUMENTS

| | | | | |
|---|---|---|---|---|
| 5,297,833 | A | 3/1994 | Willis et al. | |
| 5,335,756 | A | 8/1994 | Penisson | |
| 5,484,040 | A | 1/1996 | Penisson | |
| 5,522,464 | A | 6/1996 | Piper | |
| 5,732,909 | A | 3/1998 | Sonnier | |
| 5,791,410 | A | 8/1998 | Castille et al. | |
| 5,848,647 | A | 12/1998 | Webre et al. | |
| 5,909,768 | A | 6/1999 | Castille et al. | |
| 5,992,801 | A | 11/1999 | Torres | |
| 6,089,338 | A * | 7/2000 | Bouligny, Jr. | 175/423 |
| 6,192,981 | B1 | 2/2001 | Boquet et al. | |
| 6,264,395 | B1 | 7/2001 | Allamon et al. | |
| 6,311,792 | B1 | 11/2001 | Scott et al. | |
| 6,378,399 | B1 * | 4/2002 | Bangert | 81/57.15 |
| 6,394,201 | B1 | 5/2002 | Feigel et al. | |
| 6,471,439 | B2 | 10/2002 | Allamon et al. | |
| 6,631,792 | B2 | 10/2003 | Buck | |
| 6,637,526 | B2 * | 10/2003 | Juhasz et al. | 175/52 |

(Continued)

FOREIGN PATENT DOCUMENTS

| | | |
|---|---|---|
| IN | 0882/DELNP/2008 | 6/2008 |
| IN | 2685/KOLNP/2010 | 10/2010 |

(Continued)

*Primary Examiner* — William P Neuder
(74) *Attorney, Agent, or Firm* — Andrews Kurth LLP

(57) ABSTRACT

A method and apparatus for facilitating running or pulling tubulars from a well bore whereby the functions of a surface mounted traditional spider/elevator are replaced by an FMS which may also be remotely controlled. The FMS comprises a main body consisting of upper and lower plates assembled in a bolted and welded configuration, a slip assembly each said slip assembly comprising a slip back, a slip, one or more die inserts, a hydraulic or pneumatic cylinder and multiple sized die blocks to conform to the tubular OCTG diameter.

58 Claims, 5 Drawing Sheets

(56) References Cited

U.S. PATENT DOCUMENTS

| | | | | |
|---|---|---|---|---|
| 6,640,939 | B2 | 11/2003 | Buck | |
| 6,820,705 | B2 | 11/2004 | Baugh | |
| 6,845,814 | B2 | 1/2005 | Mason et al. | |
| 7,036,397 | B2 * | 5/2006 | Bangert | 81/57.5 |
| 7,086,461 | B2 | 8/2006 | Schulze-Beckinghausen et al. | |
| 7,252,161 | B2 | 8/2007 | Ayling | |
| 7,267,168 | B1 | 9/2007 | Sipos | |
| 7,293,618 | B2 | 11/2007 | Belik | |
| 7,395,855 | B2 | 7/2008 | Ayling | |
| 7,419,008 | B2 | 9/2008 | Campisi et al. | |
| 7,681,649 | B2 | 3/2010 | Cerovsek | |
| 7,686,088 | B2 | 3/2010 | Shahin | |
| 7,762,343 | B2 | 7/2010 | Sonneveld et al. | |
| 7,775,270 | B1 | 8/2010 | Sipos | |
| 7,832,470 | B2 | 11/2010 | Anthony | |
| 7,891,469 | B1 | 2/2011 | Sipos | |
| 7,926,577 | B2 | 4/2011 | Thomas et al. | |
| 7,980,298 | B2 | 7/2011 | Halse | |
| 8,020,627 | B2 | 9/2011 | Shahin et al. | |
| 8,327,928 | B2 | 12/2012 | Angelle et al. | |
| 8,678,112 | B2 | 3/2014 | Vatne | |
| 8,720,589 | B2 | 5/2014 | Thibodeaux, Jr. et al. | |
| 2002/0121160 | A1 * | 9/2002 | Bangert | 81/57.5 |
| 2005/0161225 | A1 * | 7/2005 | Cole et al. | 166/379 |
| 2005/0224260 | A1 * | 10/2005 | Ayling | 175/423 |
| 2007/0044976 | A1 * | 3/2007 | Isaacks et al. | 166/387 |
| 2007/0163807 | A1 * | 7/2007 | Lutzhoft et al. | 175/52 |
| 2008/0216999 | A1 * | 9/2008 | Halse | 166/75.14 |
| 2009/0120649 | A1 * | 5/2009 | Cerovsek | 166/380 |
| 2009/0229424 | A1 * | 9/2009 | Montgomery et al. | 81/57.15 |
| 2010/0319932 | A1 | 12/2010 | Angelle et al. | |

FOREIGN PATENT DOCUMENTS

| | | | |
|---|---|---|---|
| MX | PA05002822 | | 11/2005 |
| MX | 2008002798 | A1 | 1/2008 |
| MX | 2010007870 | A1 | 1/2010 |
| WO | WO2008/034262 | * | 6/2008 |

* cited by examiner

APPARATUS FOR SUPPORTING OR HANDLING TUBULARS

This application claims priority from U.S. Provisional application Ser. No. 61/340,893 ("the '893 application") filed Mar. 24, 2010. The '893 application is incorporated herein by reference.

BACKGROUND OF TIE INVENTION

The present invention relates to a method and apparatus for facilitating the connection of tubular used in the oil and gas exploration and extraction industries. More specifically, the invention relates to an apparatus for running or pulling tubular into or out of a well bore.

In the construction of oil or gas wells it is usually necessary to line the well bore with a string of steel pipes commonly known as tubular or tubing or generically as oil country tubular goods ("OCTG"). For purposes of this application, such steel pipes shall hereinafter be referred to as "tubular OCTG". Because of the length of the tubular OCTG required, individual sections of tubular OCTG are typically progressively added to the string as it is lowered into a well from a drilling rig or platform. The section to be added is restrained from falling into the well by some tubular engagement means, typically a spider or the like, and is lowered into the well to position the threaded pin of the tubular OCTG section adjacent the threaded box of the tubular OCTG in the well bore. The sections are then joined by relative rotation of the sections until such time as the desired total length has been achieved.

It is common practice to use a power tong to torque the connection to a predetermined torque in order to connect the sections of tubular OCTG. This traditional method and equipment types have been used extensively around the world for a period in excess of fifty years. While this method is in daily use it normally requires a large team of specialist personnel along with a plethora of equipment to successfully undertake this task. It is also a very dangerous task with personnel having to be located on a small platform suspended up to 15 feet from the rotary table and the power tong tethered to a steel cable under high loads.

In more recent times, a top drive may be used; this is, a top drive rotational system used for drilling purposes. Where a top drive system is used to make the connection, the use of a surface mounted slip type spider to restrain the section of tubular OCTG to be added may be problematic, due to the configuration of the spider in so much as it sits on or protrudes above the rig floor causing a further obstruction or safety hazard. It is therefore known to make use of an apparatus generically as referred to as an "FMS" or flush mounted spider, which can be inserted into the rotary table so that a section of tabular OCTG may be added or removed, and engaged therewith to hold the section in place. Such apparatus may comprise one or more slips and or toothed grapples, which may be hydraulically or pneumatically operated to engage an outer surface of the tubular. While this is advancement over the traditional approach as it lowers the equipment operational height; it has drawbacks in that because of the design characteristics of the upper section, plates, slips and or grapples may function or operate above the rotary table, thereby becoming a safety or operational problem. This method also places the tubular OCTG to be connected at a height that may still require an additional work table or platform to facilitate the connection thereof.

Secondly as the slips and or grapples tend to be functioned using only two pneumatic or hydraulic cylinders mounted to a horseshoe or split ring whereby side loading of the tools can occur if misalignment is an issue thereby scarring can occur to the outside surface of the tubular OCTG and its integrity thereof.

The intention of the present invention is to offer a much-improved method for an FMS for running tubular OCTG into a borehole without the shortfalls in the tools available today.

SUMMARY OF THE INVENTION

An apparatus has been invented for handling tubular OCTG. The apparatus is mountable inside a rotary table as a true FMS and can be used to grip the tubular OCTG from the outside. The system comprises an outer body, slip backs, slip fronts and gripping pads or die blocks.

The operator can remotely manipulate the FMS to extend or retract the hydraulic or pneumatic cylinders causing a relative movement in the slip bodies and gripper pads or die blocks to grip the outer surface of the tubular OCTG and secure it in the rotary table on the drill floor. Once the operator has activated the hydraulic or pneumatic cylinders thereby causing relative movement in the slip bodies and gripper pads or die blocks to grip the tubular OCTG, then torque may be applied using the rotational capability of the top drive or a traditional style power tong to remotely couple the two joints of tubular OCTG together.

According to a first aspect of the present invention, there is provided an outer body, slip backs, slip fronts and gripping pads or die blocks, wherein the outer body is manufactured utilizing standard machining practices and plate cutting techniques such as torch cutting, plasma cutting, laser cutting, and water-jet cutting thereby eliminating the need for castings.

According to a second aspect of the present invention, the outer body is manufactured and assembled using a bolted and welded construction process.

According to a third aspect of the present invention, each set of slip backs and or slip fronts may each contain a hydraulic or pneumatic cylinder in direct engagement and axial alignment with the slips, thus negating the need for any linking mechanisms there between.

According to a fourth aspect of the present invention, the outer body uses a series of spherical balls or rollers each partially encased by a housing. This allows a portion of each ball or roller to protrude from its respective housing, the protruding portion of the ball or roller to contact the tubular OCTG allowing it to move in a vertical position such is the case running in or out of the hole or in a rotating motion such is the case with drilling, milling, reaming or fishing with casing.

The present invention may further comprise a control system that is able to manipulate the hydraulic or pneumatic cylinders and other elements of all aspects of the present invention. The control system of the present invention is able to manipulate the hydraulic or pneumatic cylinders utilizing either a wireless communication system or a system of hydraulic or pneumatic control line umbilical. The system may also be coupled conventionally using a series of cables should the use of wireless communication be restricted.

The control system is also able to set and unset the hydraulic or pneumatic cylinders used to manipulate the slip backs, slip fronts and gripping pads or die blocks to contact the tubular OCTG thereby to secure the tubular OCTG in the rotary table. The control system is also able to monitor feedback loops that include sensors or monitors on the elements of the present invention. For example, sensors of the control system of the present invention may monitor the open and close status of transfer elevators, the status of a hydraulic actuator and the set or unset position of the slipper gripper pads or die blocks. The control system is designed or rated for use in a hazardous working environment. Communication with the processor of the control system is accomplished through a wireless communications link. The control system is also able to monitor feedback loops that include sensors or monitors on the elements of the present invention. For example, sensors of the control system of the present invention monitor the open and close status of the FMS and or other elements. The control system is designed or rated for use in a hazardous working environment. Communication with the processor of the control system can be accomplished through a wireless communications link, these may include Zone 1 or Zone II certified components. The hydraulic circuit shall contain a metering device such that all hydraulic or pneumatic cylinders stroke at a uniform rate upon activation.

By reversing the process the tubular OCTG members can be removed from a well bore if desired.

it is an object of this invention to provide a tubular gripping apparatus for supporting or handling a tubular, with a) two or more main upper plates and two or more lower plates forming an opening there through to accept a tubular (a "tubular guiding system"), b) a plurality of slip assemblies evenly distributed about a central axis, c) each slip assembly comprising a slip back, a slip, one or more die inserts, and a hydraulic or pneumatic cylinder, and d) each of said slip backs are affixed to a main upper plate and a lower plate, and the entire assembly is hinged in at least one place thereby allowing the gripping apparatus to open, allowing a tubular to be inserted or removed in a radial direction in relation to the central axis, and a hinge pin is substantially retained to the gripping apparatus by some means such as threads, retainer rings, snap rings, set screws, cotter pins, R clips, etc. with at least one pin being removable to allow the gripping apparatus to open. It is further intended that the slips be in sliding engagement with the slip backs and the slips move in both a vertical and radial direction simultaneously as they travel up or down the inclined surface of the slip backs, the slips are in sliding abutment with the slip backs, and the slips move in both a vertical and radial direction simultaneously as they travel up or down the inclined surface of the slip backs, which inclined surfaces may be between 6 degrees and 20 degrees in relation to a vertical axis or between 9 degrees and 14 degrees in relation to a vertical axis It is a further object of this invention that the hydraulic or pneumatic cylinders are mounted in a cavity formed between the slips and slip backs, thus are in axial alignment with the inclined surfaces of the slips and slip backs, and the hydraulic cylinders are configured such that hydraulic pressure is applied to the largest area of the hydraulic piston for exerting a force to urge the slips down the inclined surface toward a gripping or latched position, thus providing for maximum gripping force for a given applied hydraulic pressure, and further that the hydraulic or pneumatic cylinders are in direct engagement and axial alignment with the slips, thus negating the need for any linking mechanisms there between, and hydraulic or pneumatic fittings connected to the retract or extend port of the hydraulic cylinders are housed in a cavity in the slip backs.

It is further intended that a slip back and slip may be manufactured from a single piece of steel utilizing wire EDM (electrical discharge machining) to cut the inclined profile, thus providing a matched sliding fit there between and the inclined surfaces of the slips and slip backs are coated with a friction reduction material, plating or process such as Teflon, Xylan, chrome plating, hard dense chrome plating, diamond chrome plating, electroless nickel, etc., or plain bearing or self lubricating material such as an acetal filled bronze, etc. Likewise, all components can be manufactured utilizing standard machining, EDM (electrical discharge machining), and or forging practices as well as plate cutting techniques such as plasma cutting, laser cutting, torch cutting, and water-jet cutting, thus eliminating the need for castings and the means of attaching individual components to form a complete unit includes both bolting and welding.

It is also intended that the tubular guiding system is affixed to the upper plate (s), wherein the tubular guiding system is hinged to open in two different directions, 90 degrees to each other, and the tubular guiding system utilizes a high density urethane, polymer coated, plastic, composite or alloy member affixed or bonded to a steel member of the guiding system.

It is an object of this invention to provide a tubular gripping apparatus to be used as a flush mounted spider wherein the upper plates are configured to fit standard rotary tables, the main upper and lower plates contain one or more notches or recesses to allow the running of umbilical or control lines while running tubulars and the tubular guiding system includes a roller for assisting in running umbilical or control lines.

It is an object of this invention to provide a tubular gripping apparatus to be used as an elevator or a top drive mounted tubular running tool.

It is an object of this invention to provide a tubular gripping apparatus controlled remotely from a manual hydraulic control console, or an electro-hydraulic control console, or wirelessly controlled remotely from a touch screen or any combination thereof.

It is an object of this invention to provide a tubular gripping apparatus wherein all slip movement takes place below the rig floor and/or rotary table.

It is an object of this invention to provide a tubular gripping apparatus for supporting a tubular, with; a) a body forming an opening there through to accept a tubular, b) a plurality of slip backs evenly distributed about a central axis, c) said slip backs are constituents of said body, d) said body containing one or more torque transfer members for engagement with the rotary table, whereby torque and or reactive torque is transferred from the body to the rotary table, and where all slip movement takes place below the upper plates and/or below the rig floor and/or rotary table.

It is an object of this invention to provide a tubular gripping apparatus for handling a tubular, with a) a body forming an opening there through to accept a tubular, b) a plurality of slip backs evenly distributed about a central axis, c) said slip backs are constituents of said body d) said body containing lifting ears to provide a means of attachment to the bail arms.

It is an object of this invention to provide a tubular gripping apparatus for supporting a tubular, with; a) a body forming an opening there through to accept a tubular, b) two or more slip backs evenly distributed about a central axis, e) said slip backs are constituents of said body, d) a cavity is formed between each slip and slip back, e) a hydraulic cylinder is mounted in said cavity, and where all slip movement takes place below the upper plates and/or below the rig floor and/or rotary table.

It is an object of this invention to provide a tubular gripping apparatus for handling a tubular, with a) a body forming an opening there through to accept a tubular, b) two or more slip backs evenly distributed about a central axis, c) said slip backs are constituents of said body, d) a cavity is formed between each slip and slip back, e) a hydraulic cylinder is mounted in said cavity.

It is an object of this invention to provide a tubular OCTG supporting spider for use on a drilling rig, work-over platform, hydraulic work-over or snubbing unit with; a) a body which includes one or more upper plate (s) to be securely located in a rotary table, b) said body containing an opening there through to accommodate a tubular, c) two or more slip assemblies are evenly distributed about a central axis, d) each said slip assembly comprising a slip back, a slip, one or more die inserts, and a hydraulic cylinder, and where all slip movement takes place below the upper plates and/or below the rig floor and/or rotary table.

It is an object of this invention to provide a tubular OCTG handling elevator for use on a drilling rig, work-over platform, hydraulic work-over or snubbing unit, with; a) a body which includes lifting ears to provide a means for attachment to the bail arms, b) said body containing an opening there through to accommodate a tubular, c) two or more slip assemblies are evenly distributed about a central axis, d) each said slip assembly comprising a slip back, a slip, one or more die inserts, and a hydraulic or pneumatic cylinder.

It is an object of this invention to provide a tubular gripping apparatus for supporting or handling a tubular, with a) two or more main upper plates and two or more lower plates forming an opening there through to accept a tubular; b) a plurality of slip assemblies evenly distributed about a central axis; c) each slip assembly comprising a slip back, a slip, one or more die inserts, guide plates, and a hydraulic or pneumatic cylinder; d) each of said slip backs are affixed to a main upper plate and a lower plate, and where all slip movement takes place below the upper plates and/or below the rig floor and/or rotary table.

It is an object of this invention to provide a tubular OCTG supporting spider for use on a drilling rig, work-over platform, hydraulic work-over or snubbing unit with: a) a body which includes one or more upper plate (s) to be securely located in a rotary table, b) said body containing an opening there through to accommodate a tubular, c) two or more slip assemblies are evenly distributed about a central axis, d) each said slip assembly comprising a slip back, a slip, one or more die inserts, guide plates, and a hydraulic cylinder, and where all slip movement takes place below the upper plates and/or below the rig floor and/or rotary table.

It is an object of this invention to provide a tubular OCTG handling elevator for use on a drilling rig, work-over platform, hydraulic work-over or snubbing unit, comprising: a) a body which includes lifting ears to provide a means for attachment to the bail arms b) said body containing an opening there through to accommodate a tubular, c) two or more slip assemblies are evenly distributed about a central axis, d) each said slip assembly comprising a slip back, a slip, one or more die inserts, guide plates, and a hydraulic or pneumatic cylinder, and where all slip movement takes place below the upper plates and/or below the rig floor and/or rotary table.

BRIEF DESCRIPTION OF THE DRAWINGS

These and other aspects of the present invention will now be described by way of example only and with reference to the accompanying drawings, in which.

FIG, 15 is an elevation view of a die insert with a non-symmetric dovetail.

Figure 16:
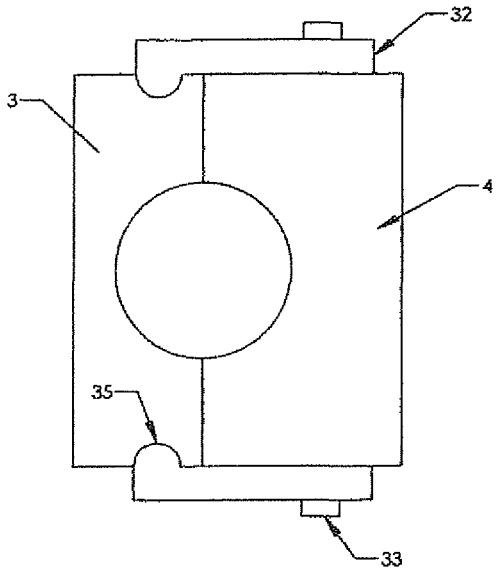

FIG. 16 is a top view of a slip assembly with guide plates.

Figure 17:
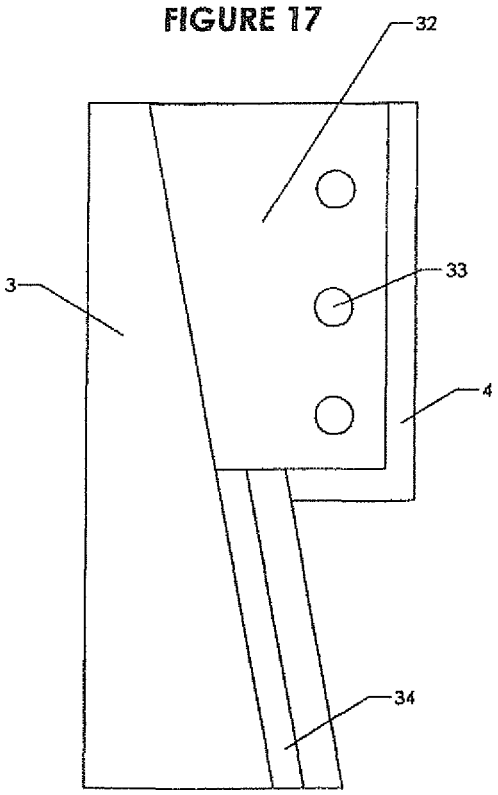

FIG. 17 is an elevation view of a slip assembly with guide plates.

DETAILED DESCRIPTION OF THE INVENTION

It will be apparent that many other changes may be made to the illustrative embodiments, while falling within the scope of the invention and it is intended that all such changes can be covered by the claims appended hereto.

Although the disclosed embodiments have been described in detail, it should be understood that various changes, substitutions and alterations can be made to the embodiments without departing from their spirit and scope. Other technical advantages of the present invention will be readily apparent to one skilled in the art from the following figures, drawings, descriptions and claims.

Referring to the drawings, shown is a gripping apparatus for supporting or handling a tubular member. The apparatus in its entirety is identified by the reference numeral 100.

Figure 1:
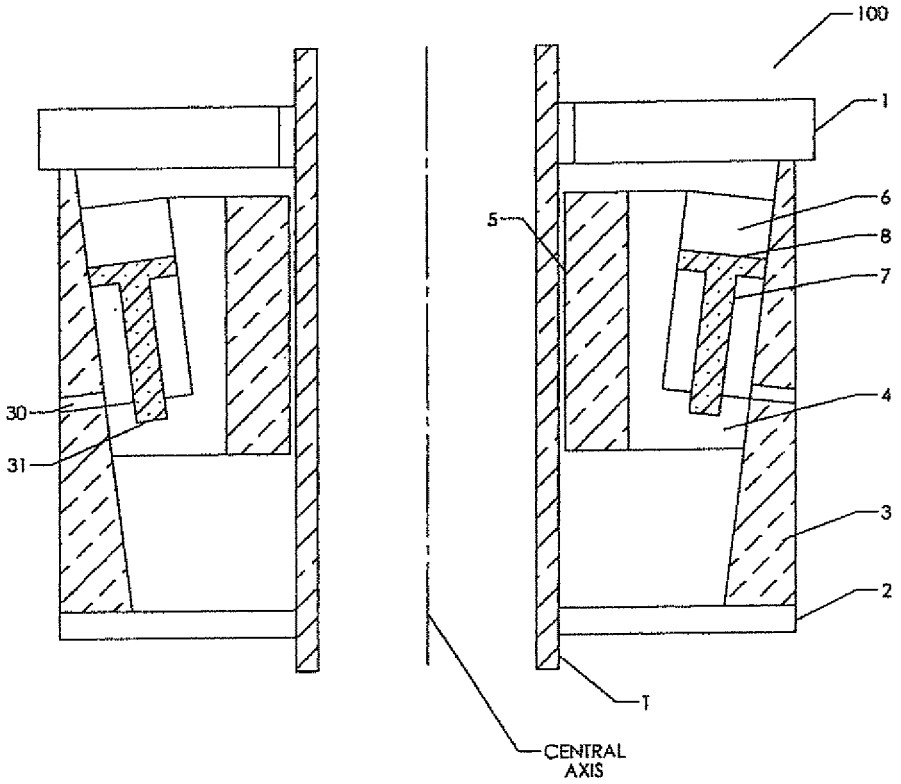
FIG. 1 is sectioned elevation view of the gripping apparatus with a tubular situated along the central axis, sectioned along line A-A of FIG. 5.
Figure 5:
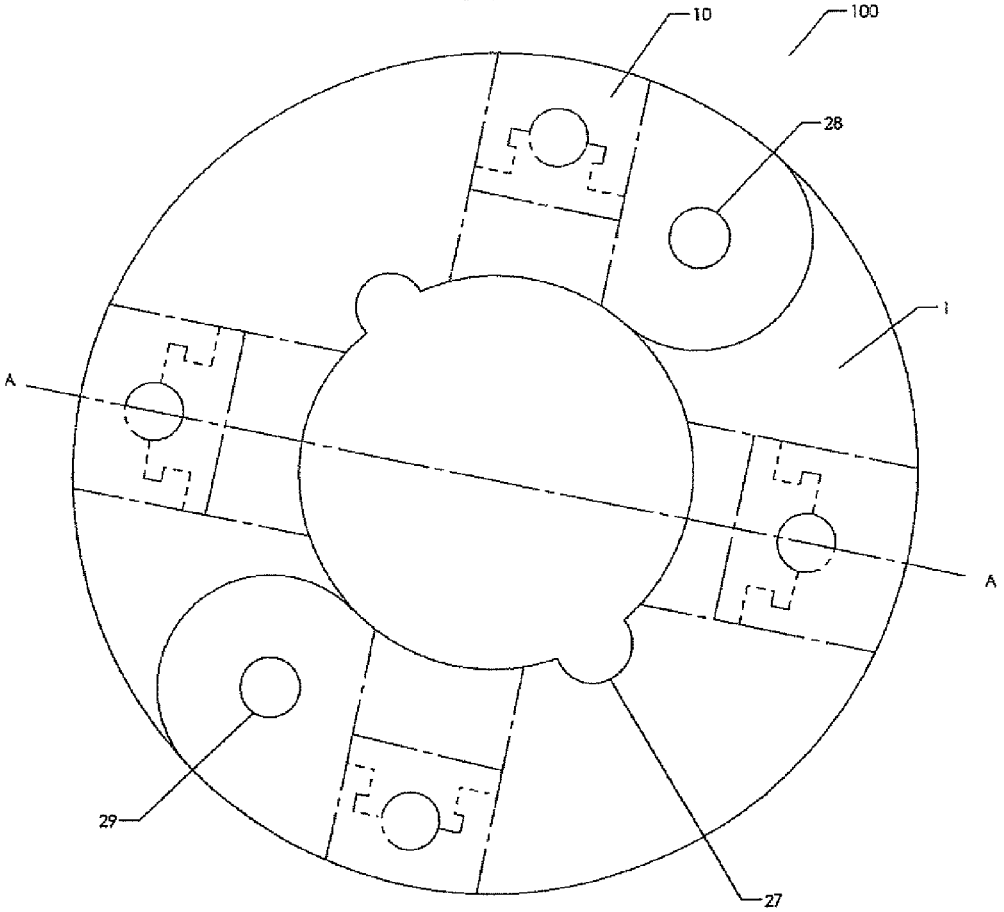
FIG. 5 is a top view of the gripping apparatus assembly.
Figure 14:
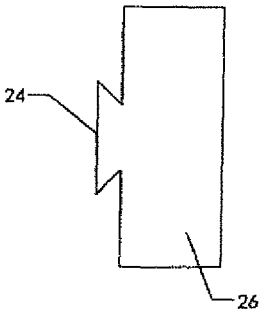
FIG. 14 is an elevation view of a die insert with a symmetric dovetail.
Figure 15:
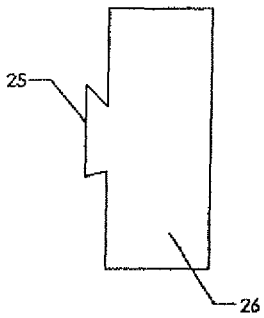

FIG. 1 shows a sectioned elevation view of the gripping apparatus 100, sectioned about line A-A of FIG. 5. This gripping apparatus can be used as a flush mounted spider to operate in a rotary table or an elevator suspended by bail arms. Illustrated in this view are the top plates 1 which are affixed to the upper surface of the slip backs 3. The lower surface of the slip backs 3 are affixed to the lower plates 2. Slips 4 are in sliding engagement with the slip backs 3. Die inserts 5 are attached to slips 4 via a symmetric dovetail profile 24 or a non symmetric dovetail profile 25 or the like, both as shown in FIGS. 14-15. These profiles may be vertical or horizontal. Double acting hydraulic cylinders 6 are disposed in a cavity formed between slip backs 3 and slips 4. The hydraulic cylinders 6 are threadedly connected to a lower surface of slips 4 at surface 31. The upper portion of the hydraulic piston 8 is the largest area of the piston, thus providing a maximum force in a downward direction for a given applied pressure. This provides a greater force to stroke the hydraulic cylinder to latch and grip a tubular than the force to release the grip on a tabular and retract the cylinder. The hydraulic cylinder rod 7 protrudes through a bore in the lower portion of the cylinder. The slip backs 3 contain a cavity 30 to allow pressure conduits access to the retract port of the hydraulic cylinders. A tubular T is disposed in the opening of the gripping apparatus along the central axis.

Figure 2:
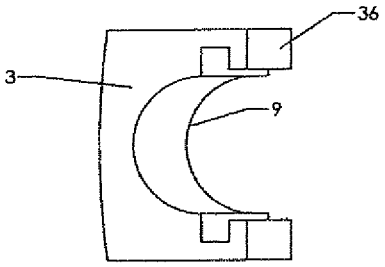
FIG. 2 is a top view of the slip back.

FIG. 2 illustrates the low bearing profile 36 and cavity profile 9 of the slip backs 3. These profiles also provide a means for the sliding engagement between the slip backs 3 and the slips 4. The load bearing surface 36 of the slip backs 3 is in sliding abutment with the load bearing surface 37 of the slips 4. These surfaces are coated with a friction reduction material or process. These friction reduction techniques aid in the efficiency of the gripping apparatus and also prevent or reduce the possibility of the abutting surfaces from friction welding to one another under heavy loads.

Figure 3:
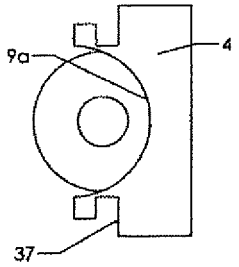
FIG. 3 is a top view of the slip.

FIG. 3 illustrates the load bearing profile 37 and cavity profile 9*a* of the slips 4. The cavities 9 and 9*a* of the slip backs and slips respectively form a cylindrical cavity wherein the hydraulic cylinders are disposed. This cylindrical cavity is in axial alignment with the inclined surfaces of the slip backs 3 and slips 4. This allows the hydraulic cylinders to also be in axial alignment with the slips 4, thus forcing the slips 4 directly up or down the inclined surface to release or grip the tubular. This removes the necessity of having linkages between the hydraulic cylinders and the slip mechanisms. For this reason, all potential forces of the hydraulic cylinders are realized. Linkages are necessary when the hydraulic , cylinders are positioned at any angle other than that of the inclined surfaces. This causes losses of the hydraulic forces as well as additional linkage parts and associated connecting pins which can be potential weak points.

Figure 4:
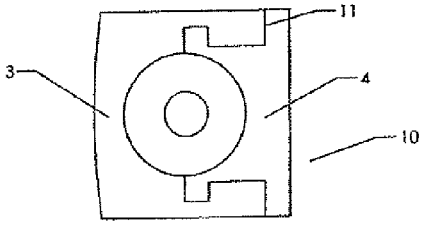
FIG. 4 is a top view of the slip assembly.

FIG. 4 illustrates a slip assembly 10 constituted by the slip backs 3 and slips 4 in sliding engagement with one another. Also shown is the cylindrical cavity formed between the slip backs 3 and slips 4. The inclined surface where load bearing surfaces 36 and 37 abut is designated as inclined surface 11. Not shown in this view are the die inserts due to the many variations possible. See FIG. 8 through FIG. 15 for possible variations.

FIG. 5 shows a top view of the gripping apparatus 100 utilizing two (2) top plates 1 and four (4) slip assemblies 10 disposed equally about the central axis. One or more notches 27 are placed into the top plates for accommodating the running of umbilical's, control lines, or the like when the gripping apparatus 100 is being utilized as a flush mounted spider. At least one of these notches 27 will be aligned with roller 16 such that umbilical's can be guided through the gripping apparatus 100 without damage. Also shown in the top plates 1 are holes 28 and 29 to accommodate the hinge pin (not shown) and removable connecting pin (not shown). These pins are to facilitate the opening of the gripping apparatus in the event a tubular must be removed in a radial direction with relation to the central axis.

Figure 6:
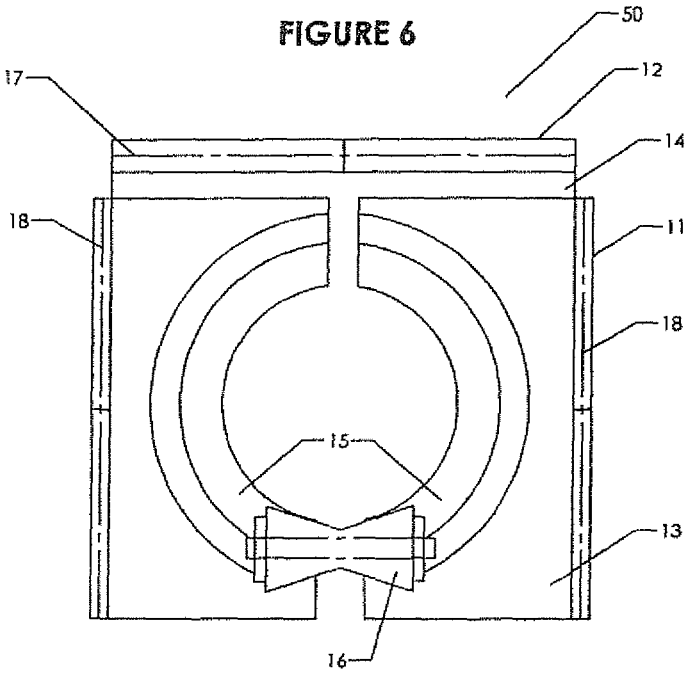
FIG. 6 is a top view of the tubular guiding system.
Figure 7:
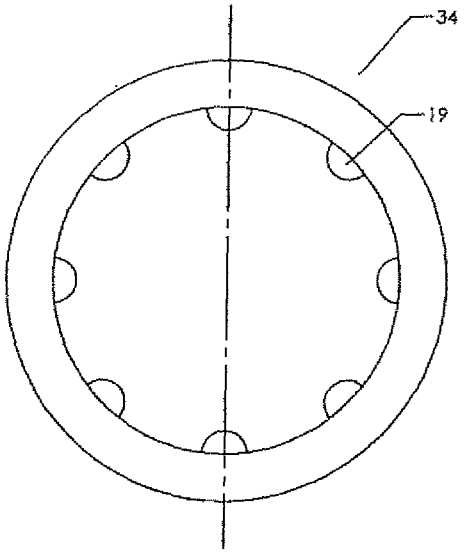
FIG. 7 is a top view of a series of rollers as a second embodiment of the tubular guiding system.

FIG. 6 is a top view of the tubular guiding system 50 which includes two (2) upper doors 13 and one (1) lower door 14. The upper doors 13 are hinged to open about axes 18 via hinges 11. The hinges 11 are affixed to both the upper doors 13 and lower door 14. Lower door 14 is hinged about axis 17 via hinge 12. Hinge 12 is affixed to both the lower door 14 and one of the top plates 1 or an additional plate (not shown) which would be affixed via bolts to a top plate 1. Thus, the two upper doors 13 are able to open independently of one another. Also, the lower plate 14 is able to open which in turn causes the attached upper doors 13 to follow suit. Attached to the upper plates 13 are guides 15. These guides 15 may be fabricated from materials such as steel, aluminum, bronze, brass, aluminum bronze, polyurethane, composites, plastics, etc. or a combination thereof. In lieu of the guide 15, a roller type guide assembly 34 may be utilized as is shown in FIG. 7. This system uses a series ball rollers 19 each partially encased by a housing. This allows a portion of each ball bearing to protrude from its respective housing. This protruding portion of the ball contacts the tubular allowing it to move in a vertical position such is the case running in or out of the hole or in a rotating Motion such is the case with drilling, milling, reaming or fishing with casing.

Figure 8:
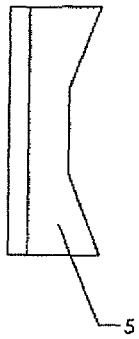
FIG. 8 is a top view of a multi faced die insert.
Figure 9:
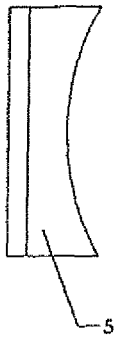
FIG. 9 is a top view of a curved die insert.
Figure 10:
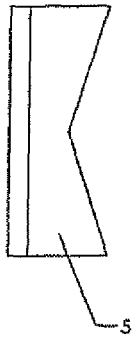
FIG. 10 is a top view of a V shaped die insert.
Figure 11:
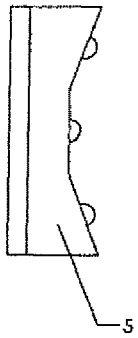
FIG. 11 is a top view of a multi faced die insert with nodules.
Figure 12:
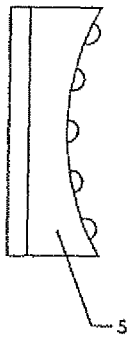
FIG. 12 is a top view of a curved die insert with nodules.
Figure 13:
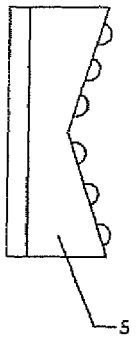
FIG. 13 is a top view of a V shaped die insert with nodules.

FIG.'s 8 through 15 illustrate various geometries, features, and profiles of the die inserts 5. FIG. 8 shows one embodiment of a die insert having a multi-faced gripping profile. FIG. 9 shows a curved gripping profile. FIG. 10 shows a V shaped gripping profile. FIGS. 11 through 13 show the same gripping profiles mentioned above with the addition of nodules on the gripping faces. These nodules may be of various shapes such as hemispherical, nodular, lumpy, sinusoidal, waveform, etc. or any combination or multitude thereof. In addition, any of the above mentioned surface profiles may be smooth, smooth and hardened, toothed, grit coated, toothed and grit coated, etc. or a combination or multitude thereof.

FIG. 14 shows a die insert 5 with a symmetrical dovetail profile 24 on its side opposite the gripping surface. This dovetail profile 24 is used as a means of attaching the die insert 5 to the slip 4 in a manner whereby the die insert can be readily changed. The need arises to change out these die inserts for several reasons such as: the outside diameter of the tubular to be gripped has changed, a different profile is needed for a specific tubular material or weight, or the die insert wears out and is no longer functional, etc. FIG. 15 is the same as FIG. 14 with the exception that the dovetail profile 25 is non symmetric.

FIG. 16 is a top view of a slip assembly illustrating the use of guide plates 32 bolted to the sides of the slip 4 and engaged with guide ways 34. The plates feature an interlocking profile 35 which is in sliding engagement with guide way 34 of the slip back 3. These plates are attached via bolts 33. The plates could alternatively be bolted to the slip back 3 with the guide way 34 on the slip 4. Also, the guide ways 34 are shown as machined slots (female profile), but could alternatively be male profiles. These guide plates 32 allow the slips 4 to be easily removed from the slip backs 3 for servicing.

FIG. 17 is an elevation view of the slip assembly utilizing the guide plates 32 and guide ways 34.

It will be apparent to those skilled in the art that many other changes can be made to the illustrative embodiments, while falling within the scope of the invention and it is intended that all such changes be covered by the claims appended hereto.

Although the disclosed embodiments have been described in detail, it should be understood that various changes, substitutions, or alterations can be made to the embodiments without departing from their spirit and scope. Other technical advantages of the present invention will be readily apparent to one skilled in the art from the following figures, drawings, descriptions and claims.

We claim:

1. A tubular gripping apparatus for supporting or handling a tubular, the apparatus comprising:

a) two or more main upper plates and two or more lower plates forming an opening there through to accept a tubular;

b) a plurality of slip assemblies evenly distributed about a central axis, wherein each slip assembly comprises a slip back with an inclined load bearing surface, a slip with a load bearing surface in sliding abutment with the inclined load bearing surface of the slip back, one or more die inserts with gripping surfaces, and a hydraulic or pneumatic cylinder, and wherein each of said slip backs has an upper surface affixed to a main upper plate and a lower surface affixed to a lower plate, and wherein the slips are in sliding engagement with the inclined surface of the slip backs, and wherein the slips move in both a vertical and radial direction simultaneously as the slip load bearing surface travels up or down the inclined load bearing surface of the slip back in a slip assembly, and wherein both the slips and slip backs have cavities that together form a cylindrical cavity in the slip assembly between the slips and slip backs and the hydraulic or pneumatic cylinders are mounted in the cylindrical cavity to be in axial alignment with the movement of the slips as they travel up or down the inclined surfaces of the slip backs.

2. The apparatus of claim 1, wherein the hydraulic cylinders comprises a piston having an upper portion and a lower portion through which a cylinder rod extends, it being recognized that the upper portion of the piston has the largest area and the pistons are configured such that hydraulic pressure is applied to the largest area of the hydraulic piston for exerting a force to urge the slips down the inclined surface of the slip backs toward a gripping or latched position, thus providing for maximum gripping force for a given applied hydraulic pressure.

3. The apparatus of claim 1, wherein the hydraulic or pneumatic cylinders are in direct engagement with and in axial alignment with the slips, thus negating the need for any linking mechanisms there between.

4. The apparatus of claim 1, wherein the slip backs contain a cavity to allow pressure conduits access to the cylinders.

5. The apparatus of claim 1, wherein the angle of the inclined load bearing surfaces of the slip backs is between 6 degrees and 20 degrees in relation to a vertical axis.

6. The apparatus of claim 1, wherein the angle of the inclined load bearing surfaces of the slip backs is between 9 degrees and 14 degrees in relation to a vertical axis.

7. The apparatus of claim 1, wherein a slip back and slip are manufactured from a single piece of steel utilizing wire electrical discharge machining to cut the inclined profile, thus providing a matched sliding fit there between.

8. The apparatus of claim 1, wherein the inclined load bearing surfaces of the slips and slip backs are coated with a friction reduction material, plating or process such as Teflon, Xylan, chrome plating, hard dense chrome plating, diamond chrome plating, electroless nickel, etc., or plain bearing or self lubricating material such as an acetal filled bronze, etc.

9. The apparatus of claim 1, wherein all components are manufactured utilizing standard machining, electrical discharge machining, or forging practices as well as plate cutting techniques such as plasma cutting, laser cutting, torch cutting, and water-jet cutting, thus eliminating the need for castings.

10. The apparatus of claim 1, whereby the means of attaching individual components to form a complete unit includes both bolting and welding.

11. The apparatus of claim 1, wherein a tubular guiding system is affixed to the main upper plates.

12. The apparatus of claim 11, wherein the tubular guiding system is hinged to open in two different directions, 90 degrees to each other.

13. The apparatus of claim 11, wherein the tubular guiding system utilizes a high density urethane, polymer coated, plastic, composite or alloy member affixed or bonded to a steel member of the tubular guiding system.

14. The apparatus of claim 1, wherein the entire assembly is hinged in at least one place with at least one hinge pin thereby allowing the tubular gripping apparatus to open, allowing a tubular to be inserted or removed in a radial direction in relation to the central axis.

15. The apparatus of claim 14, wherein the hinge pin is substantially retained to the gripping apparatus by some means such as threads, retainer rings, snap rings, set screws, cotter pins, or R

16. The apparatus of claim 14, wherein at least one hinge pin is removable to allow the gripping apparatus to open.

17. The apparatus of claim 1, wherein the gripping surface of each die insert is either: smooth, smooth and hardened, coated with a grit type material, toothed such as conventional dies and inserts, toothed and grit coated, or a combination or multitude thereof.

18. The apparatus of claim 17, wherein the gripping surface of each die insert is either: flat, v-shaped, multi-faced, or curved.

19. The apparatus of claim 17, wherein the gripping surface of each die insert is best described as: nodular, lumpy, sinusoidal, wave-form, etc., and any combination thereof.

20. The apparatus of claim 1, wherein the die inserts contain an interlocking profile such as a dovetail profile or the like on their backside opposite to the gripping surface to provide a means of retention to the slips.

21. The apparatus of claim 20, wherein the interlocking features of the dovetail profile is symmetric.

22. The apparatus of claim 20, wherein the interlocking features of the dovetail profile is not symmetric.

23. The apparatus of claim 1, further comprising a hydraulic circuit that contains a metering device such that all hydraulic or pneumatic cylinders stroke at a uniform rate upon activation.

24. The apparatus of claim 1, wherein the gripping apparatus is to be used as a flush mounted spider.

25. The apparatus of claim 24, wherein the upper plates are configured to fit standard rotary tables.

26. The apparatus of claim 24, wherein the main upper plates and lower plates contain one or more notches or recesses to allow the running of umbilical or control lines while running tubulars.

27. The apparatus of claim 26, wherein the tubular guiding system includes a roller for assisting in running umbilical or control lines.

28. The apparatus of claim 1, wherein the gripping apparatus is to be used as an elevator.

29. The apparatus of claim 1, wherein the gripping apparatus is to be used as a top drive mounted tubular running tool.

30. The apparatus of claim 1, wherein the gripping apparatus is controlled remotely from a manual hydraulic control console.

31. The apparatus of claim 1, wherein the gripping apparatus is controlled remotely from an electro-hydraulic control console.

32. The apparatus of claim 31, wherein the gripping apparatus is wirelessly controlled remotely from a touch screen.

33. The apparatus of claim 1, wherein the gripping apparatus can be controlled remotely from a electro-hydraulic control console via manual hydraulic levers or touch screen.

34. The apparatus of claim 1, wherein all slip movement takes place below the main upper plates.

35. The apparatus of claim 1, wherein all slip movement takes place below a rig floor or a rotary table.

36. The apparatus of claim 1, wherein the slip is retained to the slip back by means of a guide plate, with an interlocking feature, which is bolted to each side of the slip and slidingly engaged with each side of the slip back.

37. The apparatus of claim 1, wherein the slip is retained to the slip back by means of a guide plate, with an interlocking feature, which is bolted to each side of the slip back and slidingly engaged with each side of the slip.

38. A gripping apparatus for supporting a tubular, comprising:

a) a body forming an opening there through to accept a tubular;

b) a plurality of slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs;

c) wherein said slip backs are constituents of said body;

d) said body containing one or more torque transfer members for engagement with the rotary table, whereby torque or reactive torque is transferred from the body to the rotary table.

39. The apparatus of claim 38, wherein all slip movement takes place below the main upper plates.

40. The apparatus of claim 38, wherein all slip movement takes place below a rig floor or a rotary table.

41. A gripping apparatus for handling a tubular, comprising:

a) a body forming an opening there through to accept a tubular;

b) a plurality of slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs;

c) wherein said slip backs are constituents of said body;

d) said body containing lifting ears to provide a means of attachment to bail arms.

42. A gripping apparatus for supporting a tubular, comprising:

a) a body forming an opening there through to accept a tubular; and b) two or more slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs;

c) wherein said slip backs are constituents of said body.

43. The apparatus of claim 42 wherein all slip movement takes place below the main upper plates.

44. The apparatus of claim 42, wherein all slip movement takes place below a rig floor or a rotary table.

45. A gripping apparatus for handling a tubular, comprising:

a) a body forming an opening there through to accept a tubular; and b) two or more slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs;

c) wherein said slip backs are constituents of said body.

46. A tubular supporting spider for use on a drilling rig, work-over platform, hydraulic work-over or snubbing unit comprising:

a) a body which includes one or more main upper plates to be securely located in a rotary table;

b) said body containing an opening there through to accommodate a tubular; and c) two or more slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs.

47. The apparatus of claim 46, wherein all slip movement takes place below the main upper plates.

48. The apparatus of claim 46, wherein all slip movement takes place below a rig floor or a rotary table.

49. A tubular handling elevator for use on a drilling rig, work-over platform, hydraulic work-over or snubbing unit, comprising:

a) a body which includes lifting ears to provide a means for attachment to bail arms;

b) said body containing an opening there through to accommodate a tubular. and c) two or more slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs.

50. A tubular gripping apparatus for supporting or handling a tubular, comprising:

a) two or more main upper plates and two or more lower plates forming an opening there through to accept a tubular;

b) a plurality of slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs;

c) wherein each of said slip backs are affixed to a main upper plate and a lower plate.

51. The apparatus of claim 50, wherein all slip movement takes place below the main upper plates.

52. The apparatus of claim 50, wherein all slip movement takes place below a rig floor or a rotary table.

53. A tubular supporting spider for use on a drilling rig, work-over platform, hydraulic work-over or snubbing unit comprising:

a) a body which includes one or more main upper plates to be securely located in a rotary b) said body containing an opening there through to accommodate a tubular; and c) two or more slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, faces and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs.

54. The apparatus of claim 53, wherein all slip movement takes place below the main upper plates.

55. The apparatus of claim 53, wherein all slip movement takes place below a rig floor or a rotary table.

56. A tubular handling elevator for use on a drilling rig, work-over platform, hydraulic work-over or snubbing unit, comprising:

a) a body which includes one or more main upper plates and lifting ears to provide a means for attachment to bail arms;

b) said body containing an opening there through to accommodate a tubular; and c) two or more slip assemblies evenly distributed about a central axis, each slip assembly comprising a slip back having an inclined load bearing surface, a slip with a load bearing surface in sliding abutment with the inclined load bearing surface of the slip back, one or more die inserts with gripping surfaces, and a hydraulic or pneumatic cylinder, wherein both the slip and the slip back have cavities that together form a cylindrical cavity in the slip assembly therebetween in which the hydraulic or pneumatic cylinder is mounted to be in axial alignment with the movement of the slips as the slips travel along the inclined surfaces of the slip backs.

57. The apparatus of claim 56, wherein all slip movement takes place below the main upper plates.

58. The apparatus of claim 56, wherein all slip movement takes place below a rig floor or a rotary table.

* * * * *